US009027489B2

(12) United States Patent
Kato et al.

(10) Patent No.: US 9,027,489 B2
(45) Date of Patent: May 12, 2015

(54) SEWING MACHINE

(71) Applicants: Harumi Kato, Nagoya (JP); Midori Magara, Nagoya (JP)

(72) Inventors: Harumi Kato, Nagoya (JP); Midori Magara, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 14/204,419

(22) Filed: Mar. 11, 2014

(65) Prior Publication Data

US 2014/0290549 A1 Oct. 2, 2014

(30) Foreign Application Priority Data

Mar. 28, 2013 (JP) ..... 2013-068088

(51) Int. Cl.

*D05B 19/12* (2006.01)
*D05B 69/24* (2006.01)
*D05B 87/02* (2006.01)

(52) U.S. Cl.

CPC ..... *D05B 19/12* (2013.01); *D05B 87/02* (2013.01)

(58) Field of Classification Search

CPC ..... D05B 19/00; D05B 19/03; D05B 19/02; D05B 19/04; D05B 19/06; D05B 19/08; D05B 19/12; D05B 19/14; D05B 19/16; D05B 87/00; D05B 87/02; D05B 27/10; D05B 27/12; D05B 27/14; D05B 27/16; D05B 35/00; D05B 69/24; D05B 29/08; D05B 29/10; D05B 29/12; G05B 2219/2626

See application file for complete search history.

(56) References Cited

U.S. PATENT DOCUMENTS

| | | | | | |
|---|---|---|---|---|---|
| 4,295,435 | A * | 10/1981 | Uemura et al. | 112/322 |
| 4,413,582 | A * | 11/1983 | Landwehr et al. | 112/311 |
| 4,854,254 | A * | 8/1989 | Hsing | 112/305 |
| 5,088,426 | A * | 2/1992 | Ogawa | 112/225 |
| 6,123,039 | A * | 9/2000 | Niino | 112/235 |
| 6,138,594 | A * | 10/2000 | Kito | 112/470.01 |
| 7,281,479 | B2 | 10/2007 | Watanabe et al. | |
| 7,360,496 | B2 * | 4/2008 | Niizeki | 112/153 |
| 2006/0011121 | A1 | 1/2006 | Fujihara et al. | |
| 2009/0107374 | A1 * | 4/2009 | Ukai et al. | 112/470.06 |
| 2009/0183663 | A1 | 7/2009 | Fujihara | |
| 2009/0235855 | A1 * | 9/2009 | Hamajima | 112/275 |
| 2010/0236461 | A1 * | 9/2010 | Kawaguchi et al. | 112/102.5 |

FOREIGN PATENT DOCUMENTS

| | | |
|---|---|---|
| JP | A-61-54771 | 4/1986 |
| JP | A-62-129092 | 6/1987 |
| JP | A-11-235485 | 8/1999 |
| JP | A-2006-14835 | 1/2006 |
| JP | A-2006-158412 | 6/2006 |
| JP | A-2006-271799 | 10/2006 |
| JP | A-2009-165737 | 7/2009 |

* cited by examiner

*Primary Examiner* — Ismael Izaguirre
(74) *Attorney, Agent, or Firm* — Oliff PLC

(57) ABSTRACT

A sewing machine includes a needle bar, a presser bar, a threading device, a processor, and a memory. The needle bar is configured such that a sewing needle is attached thereto. The presser bar is configured such that an accessory device is mounted thereon. The threading device is configured to perform a threading operation in which an upper thread is passed through an eye of the sewing needle attached to the needle bar. The memory is configured to store computer-readable instructions. The computer-readable instructions cause the processor to perform processes that include determining whether a mounted device is a specific accessory device and causing the threading device to perform the threading operation in a case where it is determined that the mounted device is the specific accessory device and a specific condition is satisfied. The mounted device is an accessory device mounted on the presser bar.

6 Claims, 10 Drawing Sheets

SEWING MACHINE

CROSS-REFERENCE TO RELATED APPLICATION

This application claims priority to Japanese Patent Application No. 2013-068088 filed Mar. 28, 2013, the content of which is hereby incorporated herein by reference.

BACKGROUND

The present disclosure relates to a sewing machine that includes a threading device.

A sewing machine that includes a threading device is known. The threading device includes a threading hook, a thread guide member, a drive mechanism, and an actuator. In a case where a threading key is pressed, the actuator drives the drive mechanism. When the drive mechanism is driven, the threading hook and the thread guide member are operated and an upper thread may be automatically threaded through an eye in a sewing needle.

SUMMARY

There are cases in which a relatively large accessory device (such as an upper feed device) is mounted on a presser bar of the above-described sewing machine and used. In such a case, when the threading device is operated, a distance between the threading hook and the accessory device may be extremely small. Therefore, the threading hook may come into contact with the accessory device. If the threading hook comes into contact with the accessory device, it is possible that the threading hook may be deformed.

Embodiments of the broad principles derived herein provide a sewing machine that is capable of reliably performing a threading operation in a state in which an accessory device is mounted on a presser bar, without contact between a threading hook and the accessory device even when a threading device is operated.

Embodiments provide a sewing machine that includes a needle bar, a presser bar, a threading device, a processor, and a memory. The needle bar is configured such that a sewing needle is attached thereto. The presser bar is configured such that an accessory device is mounted thereon. The threading device is configured to perform a threading operation in which an upper thread is passed through an eye of the sewing needle attached to the needle bar. The memory is configured to store computer-readable instructions. The computer-readable instructions cause the processor to perform processes that include determining whether a mounted device is a specific accessory device and causing the threading device to perform the threading operation in a case where it is determined that the mounted device is the specific accessory device and a specific condition is satisfied. The mounted device is an accessory device mounted on the presser bar;

BRIEF DESCRIPTION OF THE DRAWINGS

Embodiments will be described below in detail with reference to the accompanying drawings in which.

DETAILED DESCRIPTION

Hereinafter, an embodiment of a sewing machine 101 will be explained.

Explanation of Sewing Machine 101

Figure 1:
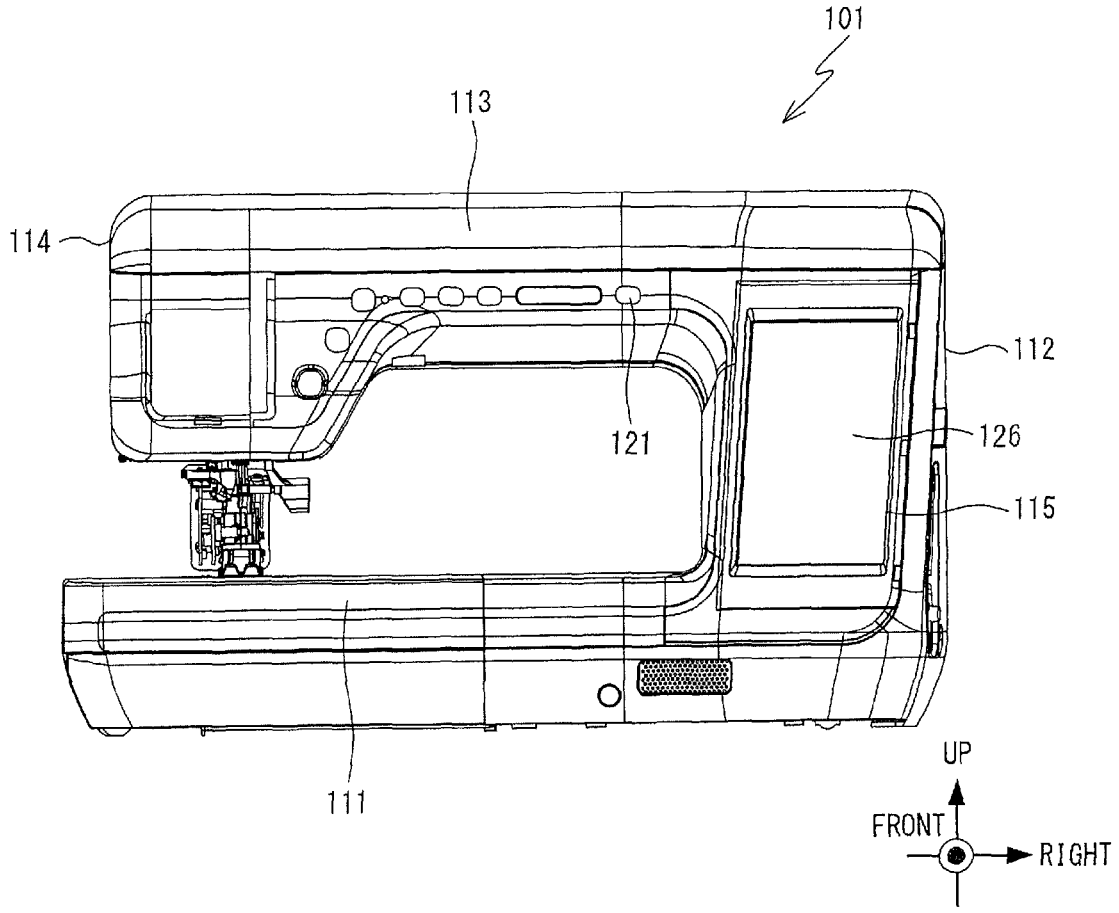
FIG. 1 is a front view of a sewing machine.

The external appearance of the sewing machine 101 will be explained with reference to FIG. 1.

The sewing machine 101 includes a bed 111, a pillar 112, an arm 113, and a head 114. The bed 111 is a base portion of the sewing machine 101. The bed 111 includes a flat surface on which a work cloth (not shown in the drawings) may be placed. The pillar 112 extends from the bed 111. The arm 113 extends from the pillar 112 while facing the bed 111. The head 114 is provided on a leading end of the arm 113.

Directions relating to the sewing machine 101 according to the present embodiment will be defined. The direction in which the pillar 112 extends from the bed 111 is the upward direction of the sewing machine 101 and the direction opposite to the upward direction is the downward direction of the sewing machine 101. The direction in which the arm 113 extends from the pillar 112 is the leftward direction of the sewing machine 101 and the direction opposite to the leftward direction is the rightward direction of the sewing machine 101. The direction that is orthogonal to the left-right direction and the up-down direction of the sewing machine 101 is the front-rear direction of the sewing machine 101. A face on which a threading switch 121, which will be explained below, is arranged is the front face of the sewing machine 101.

A vertically long rectangular liquid crystal display (LCD) 115 is provided on the front face of the pillar 112. For example, keys to execute various functions necessary to a sewing operation, various messages, various patterns, etc. may be displayed on the LCD 115.

A transparent touch panel 126 is provided on the top surface of the LCD 115. As a result, it is possible to perform selection of a sewing pattern, various settings, or the like by performing a pressing operation, using a finger or a dedicated touch pen, on a position on the touch panel 126 that corresponds to one of the various keys etc. displayed on the LCD 115.

The threading switch 121 and other operating switches are provided on a lower portion of the front face of the arm 113.

Figure 2:
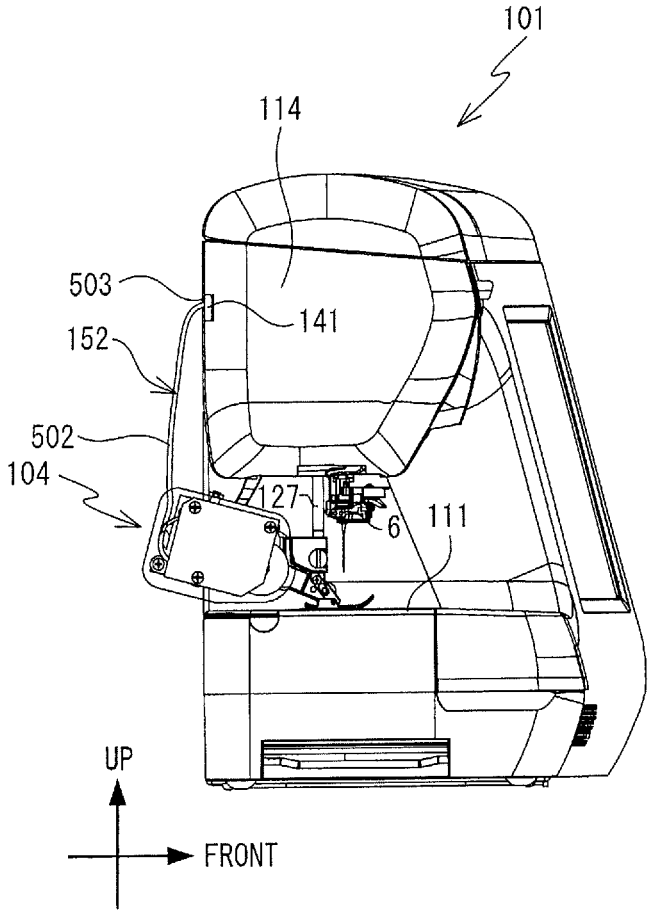
FIG. 2 is a left side view of the sewing machine.

An electrical connections of an upper feed device 104 and the sewing machine 101 will be explained with reference to FIG. 2.

A presser bar 127 is disposed at the rear of a needle bar 6. The upper feed device 104 may be detachably mounted on the lower end of the presser bar 127. The upper feed device 104 may be disposed above the bed 111. The upper feed device 104 is configured to feed the work cloth in cooperation with a feed dog (not shown in the drawings). Although not shown in the drawings, in addition to the above-described upper feed device 104, a variety of devices, such as a cloth end cutting device (a side cutter) and a ruffler (a ruffler presser foot) that have known structures, may each be mounted on the sewing machine 101 as an accessory device.

Figure 7:
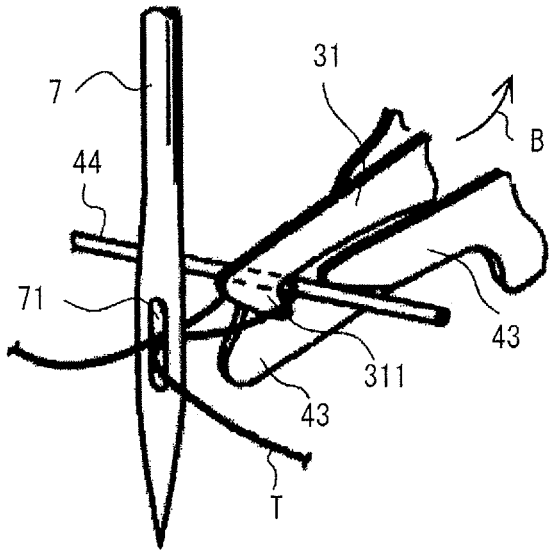
FIG. 7 is a perspective view illustrating an operation of the threading hook in threading.

An electric board 498 (refer to FIG. 3) is provided inside the upper feed device 104. A connecting portion 152 is connected to the electric board 498. The connecting portion 152 includes a lead wire 502 and a connector 503. The lead wire 502 extends from the electric board 498 to the outside of the upper feed device 104. The connector 503 is provided on the leading end of the lead wire 502. The connector 503 may be connected to a connector 141, which is provided on the head 114 of the sewing machine 101. The connector 141 is electrically connected to a control portion 60 of the sewing machine 101, which is shown in FIG. 7. A motor 491 (refer to FIG. 3) is provided inside the upper feed device 104. The motor 491 may be electrically connected to the control portion 60 of the sewing machine 101 via the electric board 498, the lead wire 502, and the connector 503. In other words, the motor 491 and the control portion 60 of the sewing machine 101 may be electrically connected by the connecting portion 152. A CPU 61, which is shown in FIG. 7, may control the motor 491.

Explanation of Upper Feed Device 104

Figure 3:
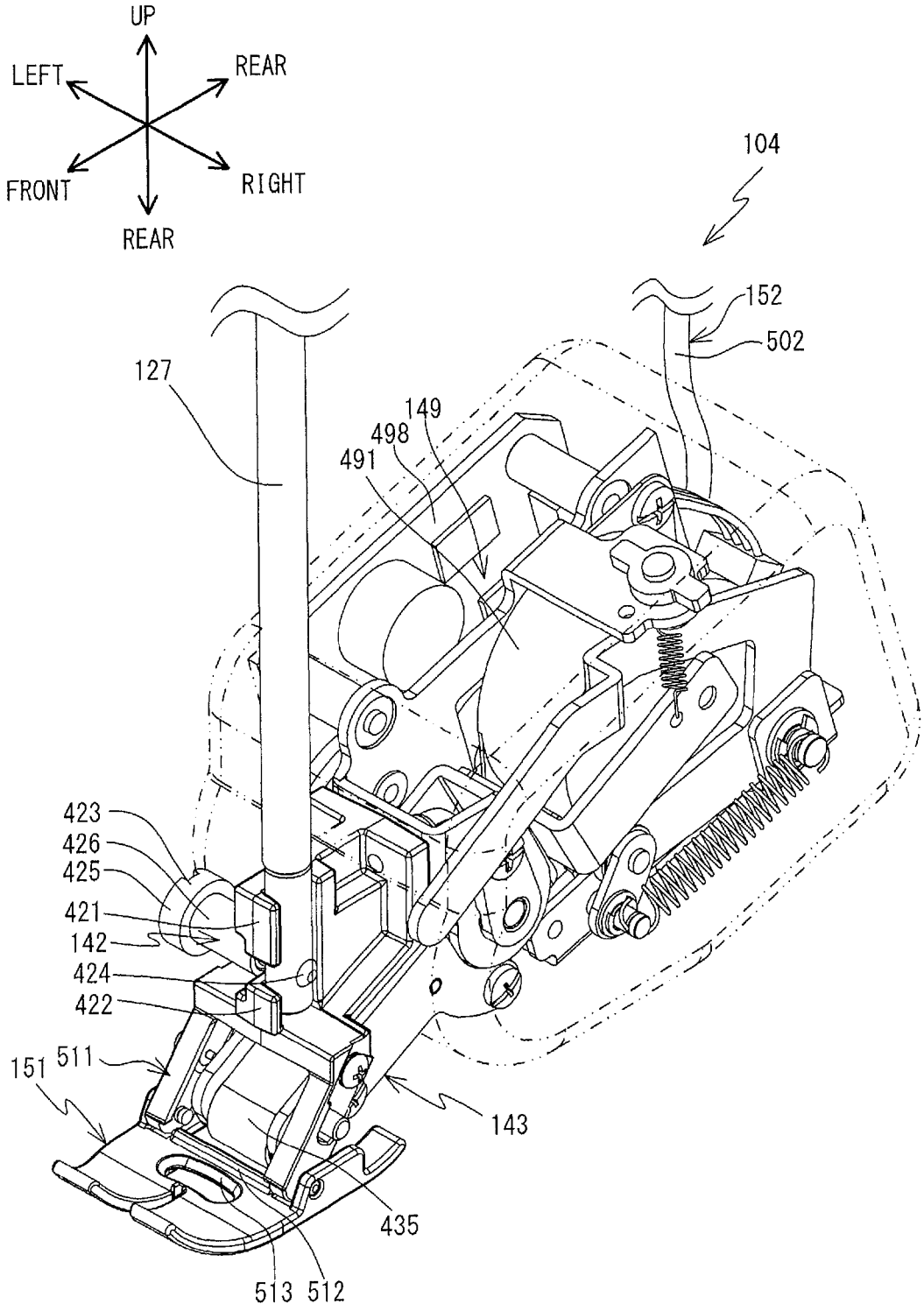
FIG. 3 is a perspective view of an upper feed device.

The upper feed device 104 will be explained with reference to FIG. 3.

The upper feed device 104 may be mounted on and removed from the presser bar 127. The upper feed device 104 includes a mounting portion 142, a feed mechanism 143, a drive mechanism 149, the connecting portion 152, and a presser foot 151. The mounting portion 142 is a portion by which the upper feed device 104 is mounted on the presser bar 127 of the sewing machine 101. The feed mechanism 143 is configured to feed the work cloth. The drive mechanism 149 is configured to drive the feed mechanism 143. The connecting portion 152 may electrically connect the motor 491, which is provided in the drive mechanism 149, to the control portion 60 of the sewing machine 101.

The mounting portion 142 and the presser foot 151 will be explained. The mounting portion 142 is provided above the feed mechanism 143 in the front end portion of the upper feed device 104. The mounting portion 142 includes two holding portions 421 and 422. The holding portions 421 and 422 may be mounted on and fixed to the presser bar 127 by a shoulder screw 423. The shoulder screw 423 includes a head 425, a shank 426, and a threaded portion 424. The outside diameter of the shank 426 is slightly smaller than the outside diameter of the head 425. The outside diameter of the threaded portion 424 is slightly smaller than the outside diameter of the shank 426. The holding portions 421 and 422 are provided on the front end of the upper feed device 104. The holding portion 421 is provided above the holding portion 422 and is slightly separated from the holding portion 422. Each of the holding portions 421 and 422 has a recessed portion that is recessed toward the left. The lower end portion of the presser bar 127 may be disposed in the recessed portions. A threaded hole (not shown in the drawings) is provided in the lower end portion of the presser bar 127. The threaded hole extends through the presser bar 127 in the left-right direction. The threaded portion 424 may be screwed into the threaded hole. A slot (not shown in the drawings) is formed in the left side face of the head 425. A tool may be fitted into the slot.

When the upper feed device 104 is mounted on the presser bar 127, the user may adjust the position of the threaded portion 424 to the screw hole portion of the presser bar 127. In this state, the user may rotate the head 425 using the user's fingers or fit the tool into the slot to rotate the head 425. As a result of this, a right side surface of the shank 426 may come into contact with left side surfaces of the holding portions 421 and 422. Further, if the shoulder screw 423 is rotated and tightened in this state, the holding portions 421 and 422 may be clamped between the shank 426 and the presser bar 127. In this state, the holding portions 421 and 422 are fixed to the presser bar 127. The upper feed device 104 may thus be mounted on the presser bar 127.

A presser foot support portion 511, which supports the presser foot 151, is provided on the lower edge portion of the holding portion 422. The presser foot support portion 511 straddles the front end portion of the feed mechanism 143 at the left and right. The presser foot support portion 511 extends obliquely downward and forward. The presser foot 151 is provided on the lower end of the presser foot support portion 511. The belt positioning portion 512 is provided at the rear of the hole 513 of the presser foot 151. The belt positioning portion 512 is a rectangular open portion that extends to the rear edge of the presser foot 151. The front end portion of the belt 435 of the feed mechanism 143 may be disposed on the inner side of the belt positioning portion 512. The front end portion of the belt 435 may feed the work cloth while pressing downward against the work cloth in the belt positioning portion 512.

The upper feed device 104 may be mounted to the presser bar 127 by the mounting portion 142. Therefore, when the presser bar 127 is moved upward, the upper feed device 104 is also moved upward and the presser foot 151 is also moved away from the work cloth. When the presser bar 127 is moved downward, the upper feed device 104 is also moved downward and the presser foot 151 also presses downward against the work cloth 100.

Explanation of Cloth Thickness Detection Mechanism 180

Figure 4:
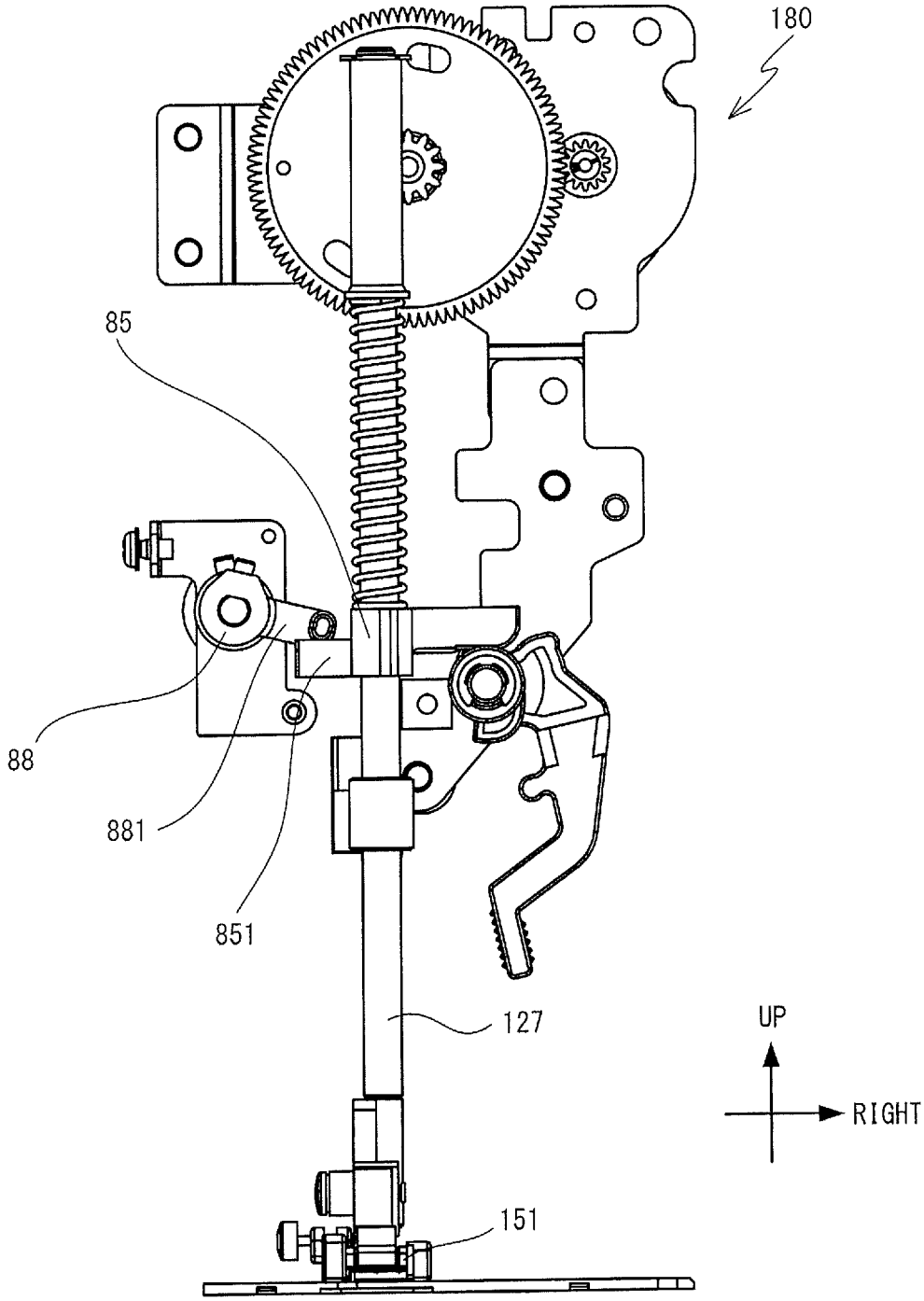
FIG. 4 is a front view of a cloth thickness detection mechanism.

The cloth thickness detection mechanism 180 will be explained with reference to FIG. 4. The cloth thickness detection mechanism 180 is provided to the rear of the needle bar 6. The cloth thickness detection mechanism 180 includes the presser bar 127, the presser foot 151, a presser bar bracket 85, and a potentiometer 88. The presser bar 127 is supported by a sewing machine frame such that the presser bar 127 may be moved up and down. The presser foot 151 is mounted on a lower end portion of the presser bar 127. The presser bar bracket 85 is fixed to substantially the center, in the up-down direction, of the presser bar 127. The potentiometer 88 is provided on the left side of the presser bar 127.

The potentiometer 88 is a rotary potentiometer. The potentiometer 88 is configured to detect a position in height of the presser bar 127. An arm 881 extends to the right from a rotating shaft of the potentiometer 88. A protruding portion 851 protrudes to the left of the presser bar bracket 85. The arm 881 is in contact with the top face side of the protruding portion 851. The arm 881 is rotated in accordance with the up/down movement of the presser bar bracket 85, and a resistance value of the potentiometer 88 changes. The control portion 60 detects the position of the presser bar 127 based on a voltage that corresponds to the resistance value of the potentiometer 88.

Explanation of Threading Device 11

The threading device 11 and its peripheral portions will be explained with reference to FIG. 5.

A needle bar base 9 extends in the up-down direction. The needle bar base 9 includes support pieces 92 and 93. The support pieces 92 and 93 extend to the right. The support pieces 92 and 93 are disposed on an upper portion and a lower portion of the needle bar base 9, respectively. The needle bar 6 is inserted through the support pieces 92 and 93 such that the needle bar 6 may be moved in the up-down direction, and is supported by the support pieces 92 and 93. A needle bar bracket 24 is positioned between the support pieces 92 and 93. The needle bar 6 is coupled to a needle bar drive mechanism by the needle bar bracket 24, and is moved up and down at a specific stroke. When the sewing operation is stopped, the needle bar 6 is stopped at a specific raised position. A positioning member 25 is attached to an upper portion of a coupling portion between the needle bar 6 and the needle bar bracket 24. The positioning member 25 includes a protruding piece 251 that protrudes to the left. A needle bar thread guide 26 is provided on the lower end of the needle bar 6.

The threading device 11 is mounted on the needle bar base 9. The threading device 11 is disposed to the left of the needle bar 6. The threading device 11 includes a first threading shaft 27, a second threading shaft 28, a threading mechanism portion 29, and a rotary mechanism 30. The threading mechanism portion 29 includes a threading hook 31 (refer to FIG. 6), a thread guide member 32, and a thread holding member 33. The threading hook 31 and the thread guide member 32 are provided on the lower end of the first threading shaft 27. The thread holding member 33 is provided on the lower end of the second threading shaft 28. The rotary mechanism 30 is configured to rotate the first threading shaft 27 around the shaft center.

The first threading shaft 27 is disposed to the left of the needle bar 6. The first threading shaft 27 extends in the up-down direction. The first threading shaft 27 is supported on the needle bar base 9 such that the first threading shaft 27 may be moved in the up-down direction and may be rotated. The second threading shaft 28 is disposed to the left of the first threading shaft 27. The second threading shaft 28 is supported on the needle bar base 9 such that the second threading shaft 28 may be moved in the up-down direction. As will be explained in more detail below, the first and second threading shafts 27 and 28 are constantly urged upward with respect to the needle bar base 9 by a compression coil spring 42. The first and second threading shafts 27 and 28 may be moved integrally in the up-down direction in a state in which positions of the upper ends of the first and second threading shafts 27 and 28 are aligned. A guide shaft 35 is fixed to the needle bar base 9. The guide shaft 35 is disposed to the left of the second threading shaft 28. The guide shaft 35 extends in the up-down direction. The guide shaft 35 guides a threading lever 40.

The threading slider 36 is inserted through the upper ends of the first and second threading shafts 27 and 28 such that the threading slider 36 may be moved in the up-down direction. The threading slider 36 is disposed across both the first and second threading shafts 27 and 28. The threading slider 36 includes a semi-circular wall portion that covers the left half of the upper portion of the first threading shaft 27. A cam groove 361 extends in a diagonal direction from the wall portion. A sliding pin 37, which extends horizontally, penetrates through the upper portion of the first threading shaft 27. The sliding pin 37 is inserted through the cam groove 361. The rotary mechanism 30 includes the sliding pin 37 and the cam groove 361. A spring receiving pin 38, which is positioned below the sliding pin 37, is provided on the first threading shaft 27. A compression coil spring 39 is provided between the spring receiving pin 38 and the lower end of the threading slider 36.

The threading lever 40 and a lever plate 41 are fittingly inserted into the guide shaft 35 such that the threading lever 40 and the lever plate 41 may be moved in the up-down direction. The threading lever 40 and the lever plate 41 are used to move the first and second threading shafts 27 and 28 in the up-down direction. The threading lever 40 extends to the left. The threading lever 40 integrally includes a cylindrical portion 401, which the guide shaft 35 is inserted through.

Two sliding ring portions 411 are provided on the lever plate 41. The guide shaft 35 is inserted into the sliding ring portions 411 such that the guide shaft 35 may be moved in the up-down direction. The two sliding ring portions 411 are disposed on the lever plate 41 such that the two sliding ring portions 411 sandwich the cylindrical portion 401 of the threading lever 40 from above and below. Further, the lever plate 41 integrally includes a plate portion that extends to the right and an operation piece 412 that is positioned on the upper end of the plate portion. The operation piece 412 is configured to come into contact with and depress the top face of the threading slider 36. The compression coil spring 42 is provided on the guide shaft 35. The compression coil spring 42 constantly urges the threading lever 40 and the lever plate 41 upward.

Figure 5:
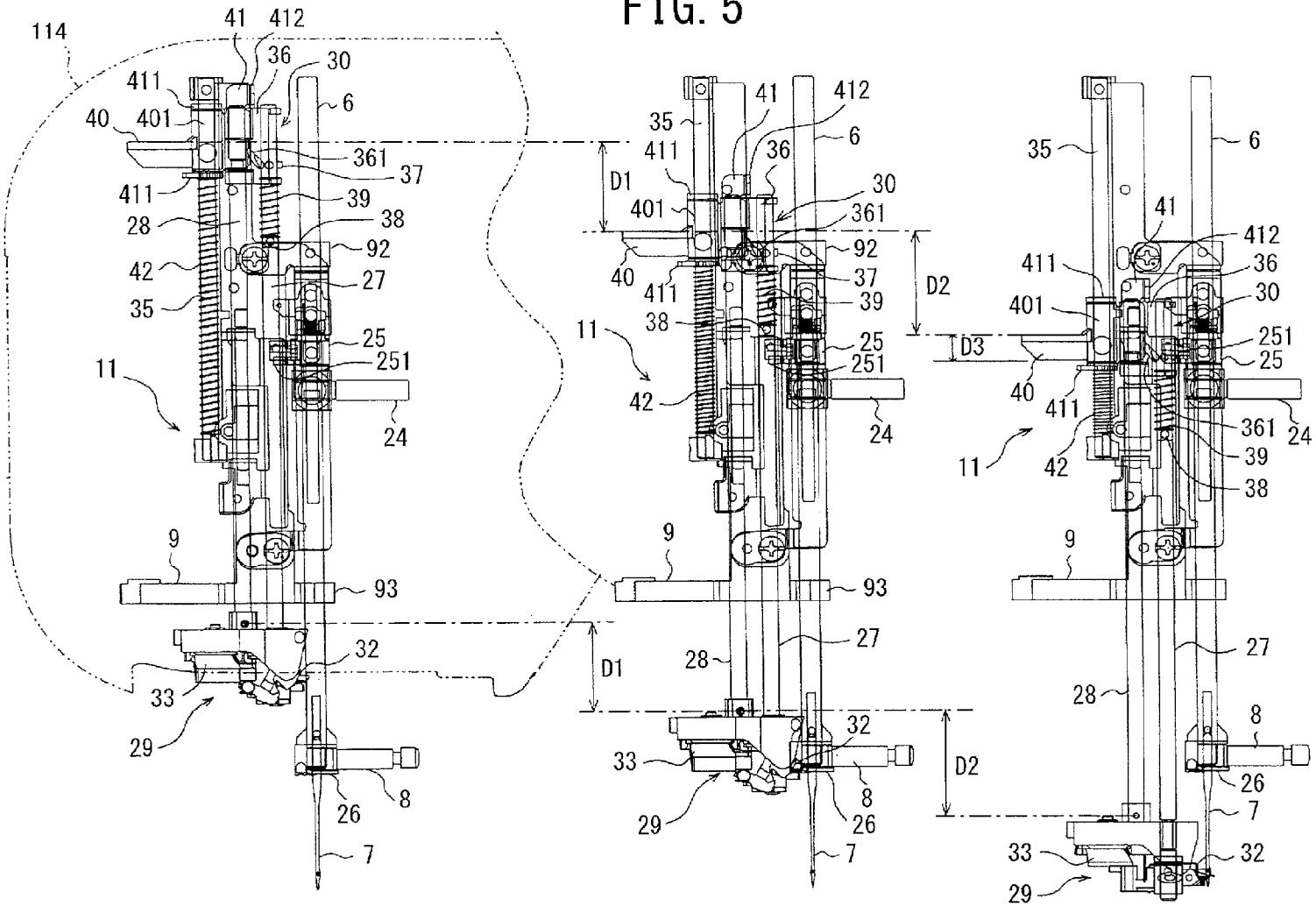
FIG. 5 shows longitudinal sectional front views of a threading device in states in which a threading mechanism portion is in a withdrawn position, in a thread laying preparing position, and in a threading operation position.

The threading device 11 shown furthest to the left in FIG. 5 is in a state in which the force to depress the threading lever 40 downward is not acting on the threading lever 40. In this state, due to the spring force of the compression coil spring 42, the threading lever 40 and the lever plate 41 are positioned on the upper end of the guide shaft 35. In the state in which the threading lever 40 and the lever plate 41 are positioned on the upper end of the guide shaft 35, the threading slider 36 and the first and second threading shafts 27 and 28 are positioned at an uppermost position with respect to the needle bar base 9. In the uppermost position, the threading mechanism portion 29 that is provided on the lower ends of the first and second threading shafts 27 and 28 is housed inside the head 114, and this position is a withdrawn position.

When the force to depress the threading lever 40 downward acts on the threading lever 40, the threading lever 40, the first and second threading shafts 27 and 28, and the threading mechanism portion 29 descend from the withdrawn position (refer to FIG. 5) by a distance D1. This position is a thread laying preparing position (refer to the threading device 11 in the center of FIG. 5). In the thread laying preparing position, the threading mechanism portion 29 is positioned at a height in the vicinity of a needle bracket 8 of the needle bar 6 that is in a needle up position above a needle. In the thread laying preparing position, a user may perform thread laying, which is an operation in preparation for threading an upper thread T.

When the force to depress the threading lever 40 downward further acts on the threading lever 40, the threading lever 40, the first and second threading shafts 27 and 28, and the threading mechanism portion 29 are moved from the thread laying preparing position. Then, at a position at which the threading lever 40, the first and second threading shafts 27 and 28, and the threading mechanism portion 29 have been moved from the thread laying preparing position by a distance D2, the sliding pin 37, which is provided on the first threading shaft 27, engages with the protruding piece 251 of the positioning member 25, which is provided on the needle bar 6. When the sliding pin 37 engages with the protruding piece 251, the downward movement of the first threading shaft 27 is regulated. This position is a threading operation position (refer to the threading device 11 furthest to the right in FIG. 5). In the threading operation position, the height position of the threading hook 31 is aligned with the height of an eye 71 of a sewing needle 7. As a result, the threading operation becomes possible.

At the time of the threading operation, the threading lever 40 is further depressed by a distance D3 from the position to which the threading lever 40 has been moved by the distance D2. As a result of the downward movement of the threading lever 40, the threading slider 36 is moved down via the lever plate 41 by the distance D3 with respect to the first and second threading shafts 27 and 28 against the spring force of the compression coil spring 39. As a result of this, the sliding pin 37 of the first threading shaft 27 is relatively moved up in a diagonal direction inside the cam groove 361 of the threading slider 36. When the sliding pin 37, which is the rotary mechanism 30, is moved up, the first threading shaft 27 and the threading hook 31 are rotated and the threading operation is performed.

When the depressing force on the threading lever 40 is released, by the spring force of the compression coil spring 39, the threading lever 40 and the threading slider 36 are moved up by the distance D3 with respect to the first and second threading shafts 27 and 28. When the threading slider 36 is moved up, the sliding pin 37 of the first threading shaft 27 is relatively moved down in a diagonal direction inside the cam groove 361 of the threading slider 36. When the sliding pin 37 descends, the first threading shaft 27 and the threading hook 31 are rotated in a reverse direction. After that, the threading lever 40 is moved up by a distance (D2+D1), and the first and second threading shafts 27 and 28 and the threading mechanism portion 29 are moved up and return to the withdrawn position, as shown by the threading device 11 furthest to the left in FIG. 5.

Figure 6:
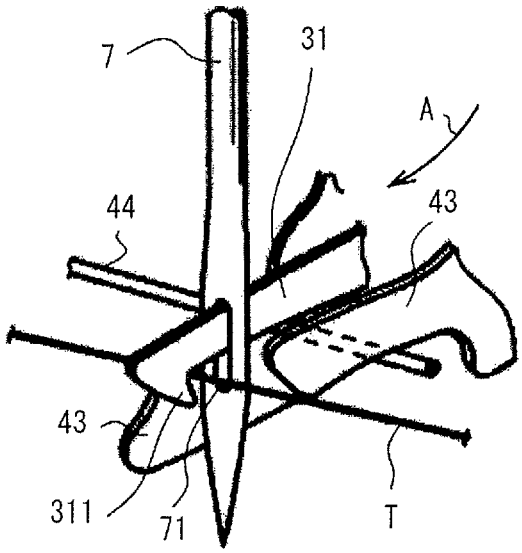
FIG. 6 is a perspective view illustrating an operation of a threading hook in threading.

The threading mechanism portion 29 (refer to FIG. 5) will be explained with reference to FIG. 6. The threading hook 31, guide members 43 and 43, and a thread holding wire 44 are provided on the lower end of the first threading shaft 27 (refer to FIG. 5). The threading hook 31 includes a hook portion 311. The hook portion 311 is provided with a downward orientation on the leading end of the threading hook 31. The threading hook 31 may be inserted through the eye 71 of the sewing needle 7. The guide members 43 and 43 are positioned on both sides of the threading hook 31. At the time of the threading operation, the thread guide member 32, which is provided on the lower end of the first threading shaft 27, is configured to hold the upper thread T in a horizontal state in front of the eye 71 of the sewing needle 7, as shown in FIG. 6.

An operation of the threading hook 31 will be explained. The threading mechanism portion 29 may be moved down to the threading operation position and the first threading shaft 27 may be rotated. When the first threading shaft 27 is rotated, the threading hook 31 is moved in the direction of an arrow A and passes through the eye 71 of the sewing needle 7, as shown in FIG. 6. Further, the threading hook 31 hooks the upper thread T that is being held by the thread guide member 32 using the hook portion 311. After that, the first threading shaft 27 may be rotated in the reverse direction. When the first threading shaft 27 is rotated in the reverse direction, the threading hook 31 is moved in reverse in the direction of an arrow B and the upper thread T passes through the eye 71 along with the threading hook 31, as shown in FIG. 7. The threading is performed in this manner. For example, Japanese Laid-Open Patent Publication No. 2006-158412 discloses a structure and an operation of a threading mechanism portion, the relevant portions of which are incorporated by reference.

The sewing machine 101 includes an up-and-down moving mechanism (not shown in the drawings) that is configured to move the threading lever 40 in the up-down direction. The up-and-down moving mechanism is driven by a threading pulse motor 520, which will be explained below. For example, Japanese Laid-Open Patent Publication No. 2009-165737 discloses a structure and an operation of an up-and-down moving mechanism, the relevant portions of which are incorporated by reference.

Electrical Configuration of Sewing Machine 101 and Upper Feed Device 104

Figure 8:
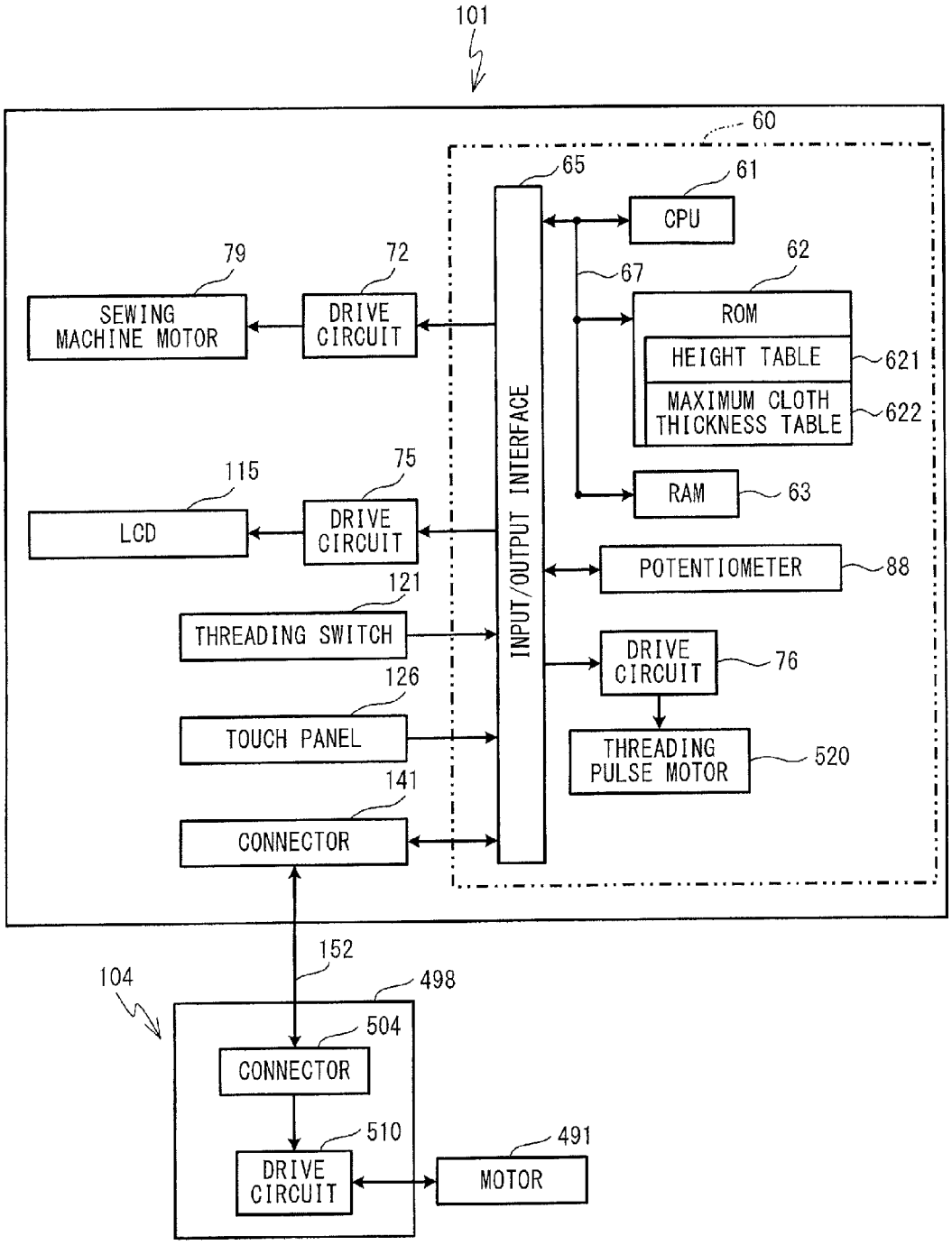
FIG. 8 is a block diagram showing an electrical configuration of the sewing machine and the upper feed device.

An electrical configuration of the sewing machine 101 and the upper feed device 104 will be explained with reference to FIG. 8. The control portion 60 of the sewing machine 101 includes the CPU 61, a ROM 62, a RAM 63, and an input/output interface 65. The CPU 61, the ROM 62, the RAM 63, and the input/output interface 65 are electrically connected to each other by a bus 67. The ROM 62 stores programs for the CPU 61 to execute processing, data, etc. Specifically, the ROM 62 stores a program to execute threading processing shown in FIG. 8, a height table 621, and a maximum cloth thickness table 622. The height table 621 includes information in which detection values of the potentiometer 88 are associated with heights of the presser foot 151. The maximum cloth thickness table 622 includes information in which types of accessory devices are associated with maximum cloth thickness values at which threading by the threading device 11 is possible. The RAM 63 stores various temporary data.

The threading switch 121, the touch panel 126, drive circuits 72, 75 and 76, the potentiometer 88, and the connector 141 are electrically connected to the input/output interface 65. The drive circuit 72 may drive a sewing machine motor 79. The drive circuit 75 may drive the LCD 115. The drive circuit 76 may drive the threading pulse motor 520. The threading lever 40 is moved in the up-down direction by the rotation of the threading pulse motor 520.

The connector 141 is connected to one end of the connecting portion 152. The connecting portion 152 is electrically connected to a connector 504. The connector 504 is electrically connected to a drive circuit 510. The connector 504 and the drive circuit 510 are mounted on the electric board 498, which is provided inside the upper feed device 104. The drive circuit 510 is electrically connected to the motor 491. The drive circuit 510 may drive the motor 491. The CPU 61 controls the drive circuit 510 and may thus control the motor 491.

When the upper feed device 104 is electrically connected to the CPU 61 of the sewing machine 101 via the connector 141, a Low signal is input to the CPU 61. When the upper feed device 104 is not electrically connected to the CPU 61, a High signal is input to the CPU 61. By detecting the Low signal or the High signal, the CPU 61 can detect whether or not the motor 491 and the control portion 60 of the sewing machine 101 are electrically connected.

Threading Processing

Figure 9:
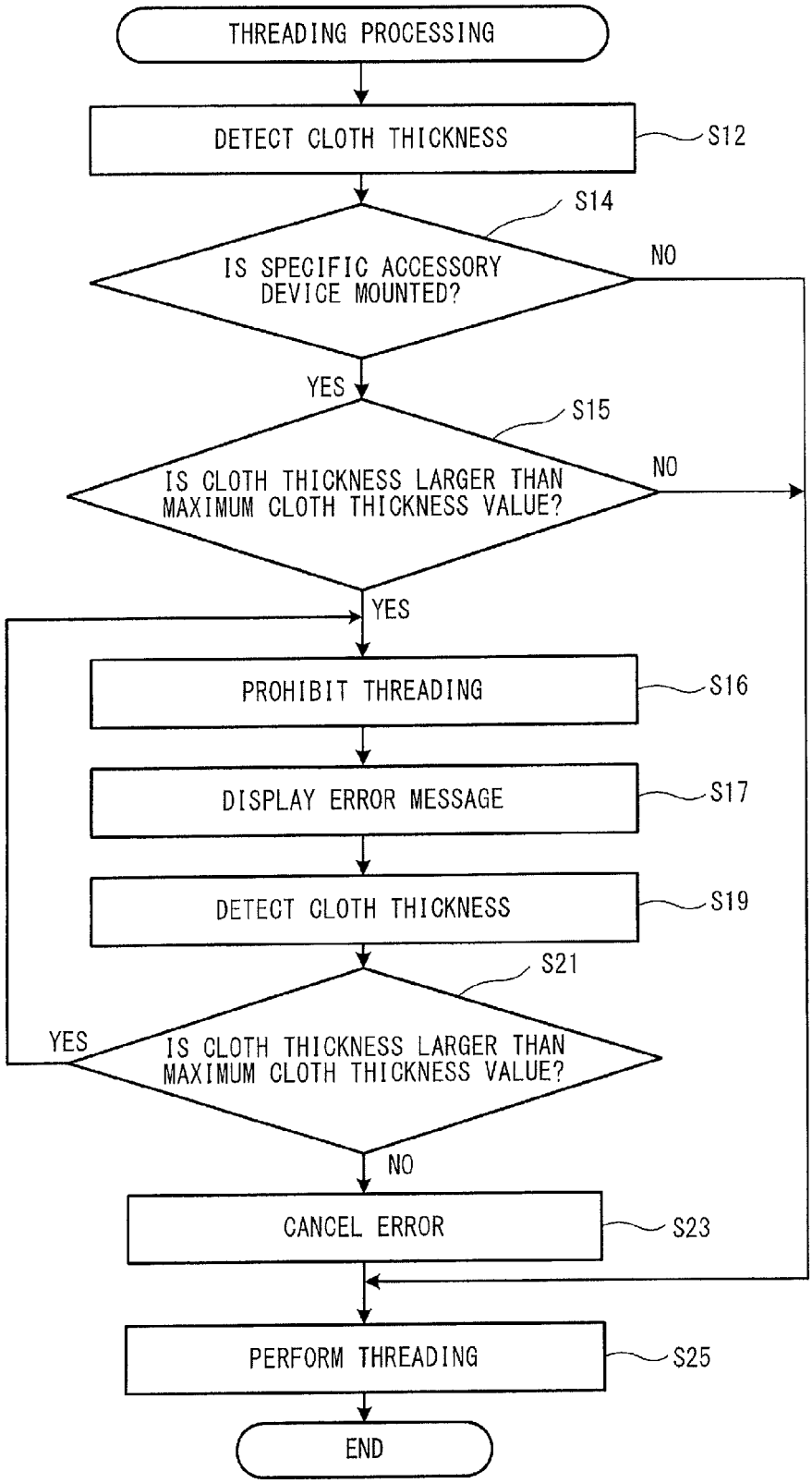
FIG. 9 is a flowchart showing threading processing.

The threading processing will be explained with reference to FIG. 9. The threading processing is executed by the CPU 61 of the sewing machine 101 in accordance with the program stored in the ROM 62. The threading processing may be executed, for example, when the user presses the threading switch 121. Each of the steps shown in the flowchart indicates the processing of the CPU 61.

At step S12, the CPU 61 outputs a control signal that instructs the potentiometer 88 to detect the thickness of the work cloth. When the potentiometer 88 receives the control signal from the CPU 61, the potentiometer 88 detects the thickness of the work cloth. More specifically, the CPU 61 detects a height of the presser foot 151 (a cloth thickness) that corresponds to a detection voltage, based on the height table 621 that is stored in the ROM 62. The RAM 63 stores the height of the presser foot 151 (the cloth thickness) in response to a control signal from the CPU 61.

At step S14, the CPU 61 determines whether or not a specific accessory device is mounted on the presser bar 127. The specific accessory device may be, for example, the upper feed device 104. More specifically, the CPU 61 may detect the Low signal from the upper feed device 104 via the connector 141. When the upper feed device 104 is not electrically connected to the CPU 61, the CPU 61 may detect the High signal.

When the CPU 61 detects the Low signal (yes at step S14), the CPU 61 advances the processing to step S15. When the CPU 61 detects the High signal (no at step S14), the CPU 61 advances the processing to step S25.

At step S15, the CPU 61 determines whether or not the cloth thickness detected at step S12 is larger than a maximum cloth thickness value that corresponds to a type of the accessory device and at which the threading is possible. More specifically, the CPU 61 reads the cloth thickness stored in the RAM 63 at step S12. Further, the CPU 61 reads the maximum cloth thickness table 622 stored in the ROM 62. The CPU 61 determines whether or not the cloth thickness stored in the RAM 63 is larger than the maximum cloth thickness value stored in the ROM 62. The maximum cloth thickness value may be, for example, a maximum value at which threading is possible when the upper feed device 104 is mounted on the presser bar 127. The maximum cloth thickness value may be, for example, 2.5 mm. When the CPU 61 determines that the detected cloth thickness is larger than the maximum cloth thickness value (yes at step S15), the CPU 61 advances the processing to step S16. When the CPU 61 determines that the detected cloth thickness is not larger than the maximum cloth thickness value (no at step S15), the CPU 61 advances the processing to step S25.

At step S16, the CPU 61 prohibits execution of the threading operation by the threading device 11. More specifically, the CPU 61 does not drive the threading pulse motor 520. When the CPU 61 does not drive the threading pulse motor 520, the threading mechanism portion 29 is in the withdrawn position shown in FIG. 5 due to the spring force of the compression coil spring 42.

Figure 10:
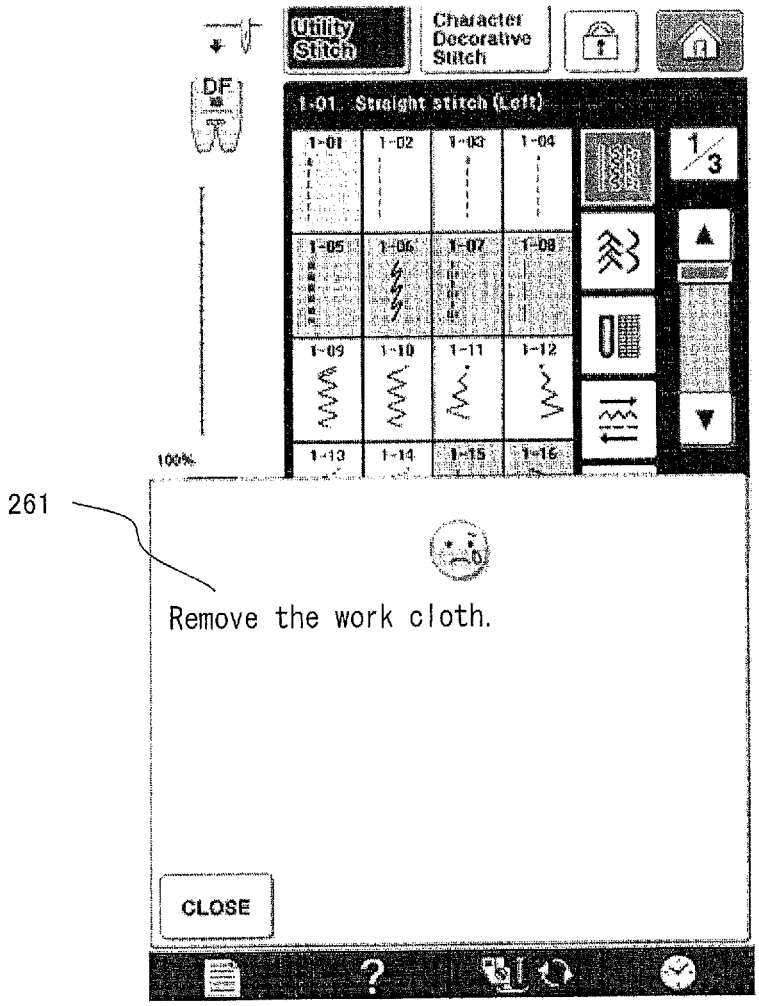
FIG. 10 is an explanatory diagram of a screen displaying an error message.

At step S17, the CPU 61 performs notification that it is not possible to perform the threading operation by the threading device 11. More specifically, the CPU 61 causes the LCD 115 to display an error message 261 shown in FIG. 10. The error message 261 may be, for example, a message instructing the user to remove the work cloth. Specifically, the CPU 61 outputs a control signal to the LCD 115 in order to display the error message 261. The LCD 115 displays the error message 261 in response to the control signal received from the CPU 61. More specifically, the CPU 61 reads image information representing the error message 261 from the ROM 62 and transmits an image signal to the LCD 115.

The user may see the error message 261 displayed on the LCD 115, and may remove the work cloth. At step S19, in a similar manner to the processing at step S12, the CPU 61 outputs a control signal that instructs the potentiometer 88 to detect the thickness of the work cloth.

At step S21, in a similar manner to the processing at step S15, the CPU 61 determines whether or not the cloth thickness detected at step S19 is larger than the maximum cloth thickness value that corresponds to the type of the accessory device and at which the threading is possible. If, for example, the user has not yet removed the work cloth, the CPU 61 determines that the cloth thickness is larger than the maximum cloth thickness value (yes at step S21) and returns the processing to step S16. On the other hand, for example, when the user has removed the work cloth, the CPU 61 determines that the cloth thickness is not larger than the maximum cloth thickness value (no at step S21) and advances the processing to step S23.

At step S23, the CPU 61 cancels the error. Specifically, the CPU 61 deletes the display of the error message 261, and outputs a control signal to the LCD 115 to display a menu screen. The LCD 115 displays the menu screen in response to the control signal from the CPU 61. More specifically, the CPU 61 reads image information representing the menu screen from the ROM 62 and transmits an image signal to the LCD 115.

At step S25, the CPU 61 outputs a control signal to the threading pulse motor 520 to perform the threading operation, as explained with reference to FIGS. 5 to 7. More specifically, the threading pulse motor 520 rotates by a specific amount in response to the control signal from the CPU 61. When the threading pulse motor 520 rotates, the threading lever 40 is depressed. When the threading lever 40 is depressed, the threading mechanism portion 29 is moved down from the withdrawn position to the threading operation position. The first threading shaft 27 and the threading hook 31 are rotated by the rotary mechanism 30 and the threading operation is performed. After that, the threading pulse motor 520 is rotated in the reverse direction, thus returns the threading mechanism portion 29 to the withdrawn position. After ending the processing at step S25, the CPU 61 ends the threading processing.

Effects of Present Embodiment

When the CPU 61 determines that the cloth thickness detected at step S15 is larger than the maximum cloth thickness value that corresponds to the type of the accessory device and at which the threading is possible, the CPU 61 prohibits the execution of the threading operation. Thus, it is possible to reliably avoid the threading hook 31 from coming into contact with the presser foot support portion 511 of the upper feed device 104.

At step S17, the LCD 115 displays the error message 261 instructing the user to remove the work cloth. By displaying the error message 261 on the LCD 115, the user can know that it is necessary to remove the work cloth in order to perform the threading operation.

Modified Examples

Hereinafter, modifications that can be added to the above-described embodiment will be exemplified.

In the present embodiment, the explanation is made in which the specific accessory device is the upper feed device 104. However, the specific accessory device is not limited to the upper feed device 104 and may be another accessory device or various presser members for which there is a possibility of contact with the threading hook 31.

In a case where there are a plurality of types of the specific accessory device or the presser member, the following control may be performed. At step S14 of the threading processing shown in FIG. 9, the CPU 61 may identify the accessory device or the presser member that is mounted on the presser bar 127. More specifically, a camera may be provided on the head 114 of the sewing machine 101. The camera may perform image capture of the accessory device or the presser member. The CPU 61 may identify the type of the accessory device or the presser member by a known pattern matching method using the captured image. The ROM 62 may store the maximum cloth thickness table 622 in which the accessory device or the presser member is associated with the maximum cloth thickness value. At step S15, the CPU 61 may read the maximum cloth thickness table 622 and may determine whether or not the cloth thickness is larger than the maximum cloth thickness value that corresponds to the type of the accessory device or presser member identified at step S14.

In the present embodiment, in order to perform notification that the threading operation by the threading device 11 is not possible, the CPU 61 displays the error message 261 on the LCD 115. However, the sewing machine 101 may be provided with a speaker or a buzzer and may output an error sound.

The above-described program may be recorded on a computer-readable storage medium, such as a hard disk, a flexible disk, a CD-ROM, or a DVD, and may be executed by being read from the storage medium by a computer. The program may be a transmission medium that can be distributed via a network such as the Internet.

In the present embodiment, the processing to determine whether or not the accessory device mounted on the presser bar 127 is the specific accessory device, the processing to determine whether or not the detected cloth thickness is larger than the maximum cloth thickness value, the processing to prohibit the execution of the threading operation, and the processing to notify that the execution of the threading operation is not possible are performed by software executed by the CPU 61, but each of the above processing may be performed by hardware.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. A sewing machine comprising:

a needle bar configured such that a sewing needle is attached thereto;

a presser bar configured such that an accessory device is mounted thereon;

a threading device configured to perform a threading operation in which an upper thread is passed through an eye of the sewing needle attached to the needle bar;

a processor; and a memory configured to store computer-readable instructions, wherein the computer-readable instructions cause the processor to perform processes comprising:

determining whether a mounted device is a specific accessory device, the mounted device being an accessory device mounted on the presser bar; and causing the threading device to perform the threading operation in a case where it is determined that the mounted device is the specific accessory device and a specific condition is satisfied.

2. The sewing machine according to claim 1, further comprising:

a cloth thickness detecting portion configured to detect a cloth thickness of a work cloth;

wherein the computer-readable instructions further cause the processor to perform processes comprising:

causing the cloth thickness detecting portion to detect the cloth thickness of the work cloth; and determining whether the cloth thickness detected by the cloth thickness detecting portion is larger than a maximum value of a cloth thickness that corresponds to a type of the mounted device and at which threading is possible, in a case where it is determined that the mounted device is the specific accessory device, the specific condition is that the detected cloth thickness is not larger than the maximum value, and the causing the threading device to perform the threading operation includes causing the threading device to perform the threading operation in a case where it is determined that the detected cloth thickness is not larger than the maximum value.

3. The sewing machine according to claim 2, further comprising:

a storage portion configured to store information in which the type of the mounted device is associated with the maximum value of the cloth thickness at which the threading is possible by the threading device;

wherein the determining whether the detected cloth thickness is larger than the maximum value includes reading the information stored in the storage portion and determining whether the detected cloth thickness is larger than the maximum value that is associated with the type of the mounted device.

4. The sewing machine according to claim 2, further comprising:

a notification portion configured to perform notification of information;

wherein the computer-readable instructions further cause the processor to perform a process comprising:

causing the notification portion to perform notification that the threading operation by the threading device is not possible, in a case where it is determined that the detected cloth thickness is larger than the maximum value.

5. The sewing machine according to claim 4, wherein the notification portion includes a display portion, and the causing the notification portion to perform notification that the threading operation is not possible includes causing the display portion to display a message instructing a user to remove the work cloth.

6. The sewing machine according to claim 1, wherein the specific accessory device includes an upper feed device being configured to feed a work cloth.

* * * * *